US009424979B2

(12) United States Patent
Lin et al.

(10) Patent No.: US 9,424,979 B2
(45) Date of Patent: Aug. 23, 2016

(54) MAGNETIC ELEMENT WITH MULTIPLE AIR GAPS

(71) Applicant: DELTA ELECTRONICS, INC., Taoyuan Hsien (TW)

(72) Inventors: Han-Hsing Lin, Taoyuan Hsien (TW); Chien-Hung Liu, Taoyuan Hsien (TW); Yu-Liang Hung, Taoyuan Hsien (TW); Kun-Te Chen, Taoyuan Hsien (TW); Yi-Lin Chen, Taoyuan Hsien (TW); Fan-Lin Liu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 64 days.

(21) Appl. No.: 14/510,437

(22) Filed: Oct. 9, 2014

(65) Prior Publication Data

US 2015/0302968 A1 Oct. 22, 2015

(30) Foreign Application Priority Data

Apr. 16, 2014 (TW) ..... 103113816 A

(51) Int. Cl.

| | |
|---|---|
| ***H01F 27/30*** | (2006.01) |
| ***H01F 27/24*** | (2006.01) |
| ***H01F 3/14*** | (2006.01) |
| ***H01F 17/04*** | (2006.01) |
| ***H01F 27/34*** | (2006.01) |

(52) U.S. Cl.

CPC ..... *H01F 27/24* (2013.01); *H01F 3/14* (2013.01); *H01F 17/045* (2013.01); *H01F 27/30* (2013.01); *H01F 27/346* (2013.01); *H01F 27/306* (2013.01)

(58) Field of Classification Search

CPC ..... H01F 5/00; H01F 27/00–27/35
USPC ..... 336/65, 83, 192, 196, 198, 200, 336/220–223, 212, 232
See application file for complete search history.

(56) References Cited

U.S. PATENT DOCUMENTS

| | | | | | |
|---|---|---|---|---|---|
| 4,240,057 | A * | 12/1980 | Decher | H01F 38/10 | 336/165 |
| 5,696,477 | A * | 12/1997 | Yamamori | H01F 27/027 | 336/185 |
| 5,726,615 | A * | 3/1998 | Bloom | H01F 27/255 | 336/178 |

(Continued)

FOREIGN PATENT DOCUMENTS

| | | |
|---|---|---|
| CN | 103310953 | 9/2013 |
| JP | 2004207371 | 7/2004 |
| JP | 2007311605 | 11/2007 |

*Primary Examiner* — Tuyen Nguyen
(74) *Attorney, Agent, or Firm* — Kirton McConkie; Evan R. Witt

(57) ABSTRACT

A magnetic element includes a first magnetic core, a second magnetic core, an intermediate magnetic core, a first winding coil, and a second winding coil. The intermediate magnetic core is arranged between the first magnetic core and the second magnetic core. After the first magnetic core and the intermediate magnetic core are coupled with each other, a first winding space and a first air gap are defined. After the second magnetic core and the intermediate magnetic core are coupled with each other, a second winding space and a second air gap are defined. The first winding coil is disposed within the first winding space and arranged around the first air gap. The second winding coil is disposed within the second winding space and arranged around the second air gap. The first winding coil and the second winding coil are connected with each other in series.

9 Claims, 5 Drawing Sheets

(56) References Cited

U.S. PATENT DOCUMENTS 7,142,081 B1 * 11/2006 Shudarek ..... H01F 27/24 336/178
7,598,839 B1 * 10/2009 Wedley ..... H01F 3/12 336/131
8,031,042 B2 * 10/2011 Silva ..... H01F 3/10 336/178
8,120,457 B2 * 2/2012 Hu ..... H01F 29/14 336/178
2006/0290458 A1 12/2006 Sano
2009/0295524 A1 12/2009 Silva
2011/0115593 A1 * 5/2011 Liao ..... H01F 27/02 336/90
2012/0206230 A1 * 8/2012 Liao ..... H01F 27/29 336/192

* cited by examiner

MAGNETIC ELEMENT WITH MULTIPLE AIR GAPS

TECHNICAL FIELD

The present disclosure relates to a magnetic element, and more particularly to a magnetic element with multiple air gaps.

BACKGROUND OF THE DISCLOSURE

Nowadays, magnetic elements such as inductors and transformers are widely used in power supply apparatuses or other electronic devices in order to generate induced magnetic fluxes.

Take an inductor as an example. FIG. 1A is a schematic exploded view illustrating an inductor with an air gap. FIG. 1B is a schematic assembled view illustrating a portion of the inductor of FIG. 1A, in which the bobbin and the winding coil are not shown. The inductor 1 may be applied to a power factor correction circuit or a resonant circuit of a power supply apparatus. The conventional inductor 1 comprises a bobbin 10, a first magnetic core 11, a second magnetic core 12, and a winding coil 13. The bobbin 10 comprises a channel 101 and a winding section 102. A middle post 111 of the first magnetic core 11 and a middle post 121 of the second magnetic core 12 are embedded within the channel 101. The winding coil 13 is wound around the winding section 102. The first magnetic core 11 and second magnetic core 12 are arranged on opposite sides of the bobbin 10. Moreover, an air gap 14 is formed between a middle post 111 of the first magnetic core 11 and a middle post 121 of the second magnetic core 12. After the bobbin 10, the first magnetic core 11, the second magnetic core 12 and the winding coil 13 are combined together, the inductor 1 with the air gap 14 is fabricated.

Recently, the magnetic element of the power supply apparatus is designed to have increased power (watt), reduced height and increased winding space. In the inductor 1, the winding coil 13 is fixed on the bobbin 10 and arranged between the first magnetic core 11 and second magnetic core 12, and the air gap 14 is covered by the winding coil 13. Due to the volume of the bobbin 10, the space between the first magnetic core 11 and second magnetic core 12 for accommodating the winding coil 13 is restricted and the coil utilization is reduced. Under this circumstance, since the diameter of the winding coil 13 is limited, the overall temperature of the inductor 1 is very high and the working efficiency of the inductor 1 is impaired. Moreover, the single air gap 14 between the middle post 111 of the first magnetic core 11 and the middle post 121 of the second magnetic core 12 may avoid the generation of magnetic saturation. However, the larger air gap may result in higher leakage flux. Under this circumstance, the eddy loss is increased, the overall temperature of the inductor 1 is increased, and the working efficiency of the inductor 1 is reduced.

Therefore, there is a need of providing a magnetic element with multiple air gaps in order to eliminate the above drawbacks.

SUMMARY OF THE DISCLOSURE

The present disclosure provides a magnetic element with multiple air gaps. The coils are directly wound around the magnetic cores without the need of using bobbin. Consequently, the fabricating cost is reduced, and the coil utilization is enhanced. Since the multiple air gaps of the magnetic element are dispersedly distributed, the eddy loss is reduced and the dispersing flux is decreased. Under this circumstance, the working temperature of the magnetic element is decreased, and the working efficiency of the magnetic element is enhanced.

The present disclosure provides a magnetic element with multiple air gaps. The magnetic cores are stacked in an asymmetric configuration and the winding coils are connected with each other in series, the magnetic force lines between the two winding coils are partially balanced. Under this circumstance, the thickness of the intermediate magnetic core is reduced, the overall volume is reduced, and the magnetic element is slim.

In accordance with an aspect of the present disclosure, there is provided a magnetic element with multiple air gaps. The magnetic element includes a first magnetic core, a second magnetic core, an intermediate magnetic core, a first winding coil, and a second winding coil. The intermediate magnetic core is arranged between the first magnetic core and the second magnetic core. After the first magnetic core and the intermediate magnetic core are coupled with each other, a first winding space and a first air gap are defined. After the second magnetic core and the intermediate magnetic core are coupled with each other, a second winding space and a second air gap are defined. The first winding coil is disposed within the first winding space and arranged around the first air gap. The second winding coil is disposed within the second winding space and arranged around the second air gap. The first winding coil and the second winding coil are connected with each other in series.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 2:
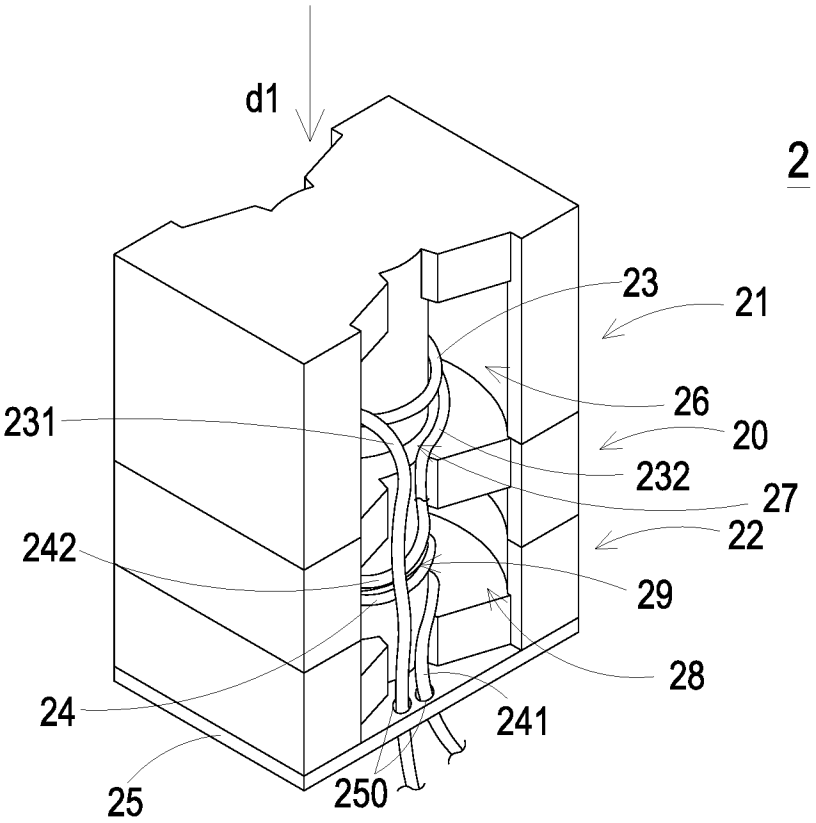
FIG. 2 is a schematic perspective view illustrating a magnetic element according to a first embodiment of the present disclosure.
Figure 3:
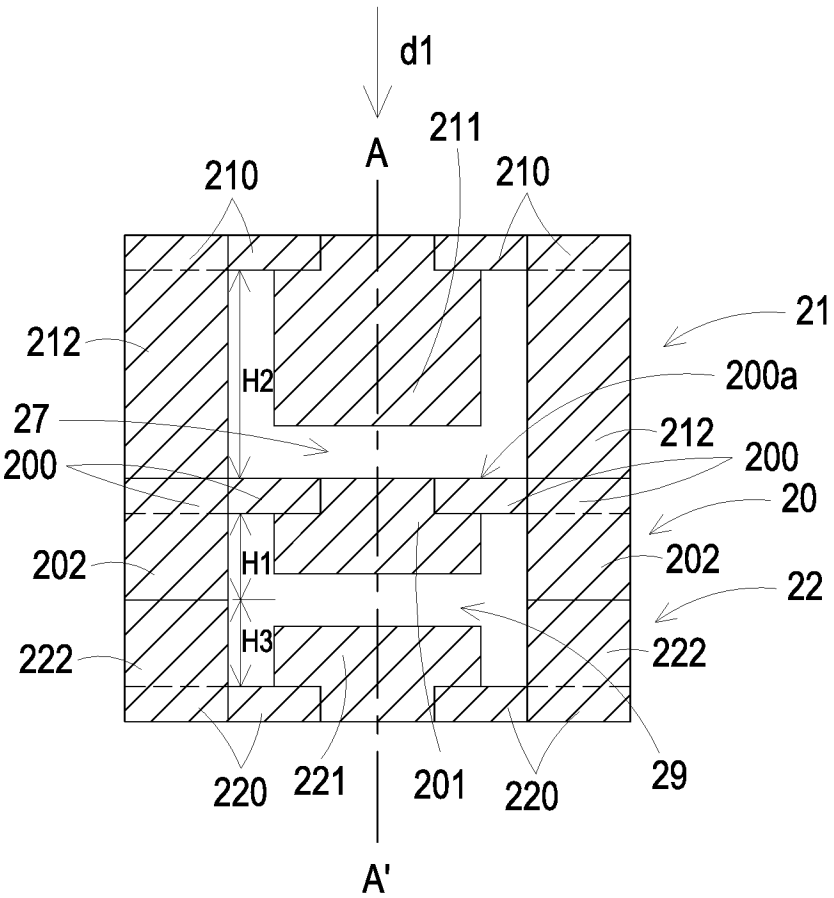
FIG. 3 is a schematic cross-sectional view illustrating the magnet cores of the magnetic element of FIG. 2.

FIG. 2 is a schematic perspective view illustrating a magnetic element according to a first embodiment of the present disclosure. FIG. 3 is a schematic cross-sectional view illustrating the magnet cores of the magnetic element of FIG. 2. The magnetic element 2 of this embodiment may be applied to a power factor correction circuit or a resonant circuit of a power supply apparatus. Moreover, the magnetic element 2 is bobbinless. An example of the magnetic element 2 includes but is not limited to an inductor or a transformer. As shown in FIGS. 2 and 3, the magnetic element 2 comprises an intermediate magnetic core 20, a first magnetic core 21, a second magnetic core 22, a first winding coil 23, and a second winding coil 24. The first magnetic core 21, the intermediate magnetic core 20 and the second magnetic core 22 are sequentially stacked on each other along a first direction d1 so as to be defined as a stacked magnetic core assembly. The intermediate magnetic core 20 is arranged between the first magnetic core 21 and the second magnetic core 22 and coupled with the first magnetic core 21 and the second magnetic core 22. The first magnetic core 21 and the second magnetic core 22 are located at opposite sides of the intermediate magnetic core 20. After the first magnetic core 21 and the intermediate magnetic core 20 are coupled with each other, a first winding space 26 and a first air gap 27 are defined. The first air gap 27 is arranged between the first magnetic core 21 and the intermediate magnetic core 20. After the second magnetic core 22 and the intermediate magnetic core 20 are coupled with each other, a second winding space 28 and a second air gap 29 are defined. The second air gap 29 is arranged between the second magnetic core 22 and the intermediate magnetic core 20. The first winding coil 23 is disposed within the first winding space 26 and arranged around the first air gap 27. The second winding coil 24 is disposed within the second winding space 28 and arranged around the second air gap 29. The first winding coil 23 and the second winding coil 24 are connected with each other in series. Consequently, the magnetic cores of the magnetic element 2 are stacked in an asymmetric configuration.

In this embodiment, the magnetic element 2 further comprises a base plate 25. For example, the base plate 25 is an insulation plate. Moreover, the second magnetic core 22 has a bottom surface (not shown), which is opposed to the intermediate magnetic core 20. The base plate 25 is attached on the bottom surface of the second magnetic core 22. Moreover, the base plate 25 has plural perforations 250. The outlet terminals of the first winding coil 23 and the second winding coil 24 may be penetrated through the perforations 250 so as to be fixed by the base plate 25. In this embodiment, the base plate 25 is attached on the bottom surface of the second magnetic core 22 via an adhesive (not shown).

Please refer to FIG. 3 again. In this embodiment, the intermediate magnetic core 20, the first magnetic core 21 and the second magnetic core 22 are all E-shaped cores. It is noted that the shapes of these magnetic cores 20, 21 and 22 are not restricted. Moreover, the intermediate magnetic core 20 comprises a connection part 200, a middle post 201, and two lateral legs 202. The first magnetic core 21 comprises a connection part 210, a middle post 211, and two lateral legs 212. The second magnetic core 22 comprises a connection part 220, a middle post 221, and two lateral legs 222. In this embodiment, the connection part 200 of the intermediate magnetic core 20, the connection part 210 of the first magnetic core 21 and the connection part 220 of the second magnetic core 22 have the same shape and the same cross-section area. Moreover, the middle post 201 of the intermediate magnetic core 20, the middle post 211 of the first magnetic core 21 and the middle post 221 of the second magnetic core 22 are cylindrical structures and have identical diameter. The centers of the middle posts 201, 211 and 221 are arranged along the same axial line A-A'. Moreover, the lateral legs 202 of the intermediate magnetic core 20, the lateral legs 212 of the first magnetic core 21 and the lateral legs 222 of the second magnetic core 22 have the same cross-section shape and the same cross-section area. When the first magnetic core 21, the intermediate magnetic core 20 and the second magnetic core 22 are coupled with each other, the first air gap 27 is formed between the middle post 211 of the first magnetic core 21 and a top surface 200*a* of the connection part 200 of the intermediate magnetic core 20, and the second air gap 29 is formed between the middle post 201 of the intermediate magnetic core 20 and the middle post 221 of the second magnetic core 22. A first magnetic path is defined by the intermediate magnetic core 20, the first magnetic core 21 and the first air gap 27 collaboratively. A second magnetic path is defined by the intermediate magnetic core 20, the second magnetic core 22 and the second air gap 29 collaboratively. After the stacked magnetic core assembly with the three magnetic cores, the first winding coil 23 and the second winding coil 24 are combined together, the magnetic element 2 is fabricated. The magnetic element 2 has two magnetic paths with leakage flux.

Please refer to FIG. 2 again. In this embodiment, the first winding coil 23 is a coil pancake that wound around the middle post 211 of the first magnetic core 21 and arranged around the first air gap 27. The first winding coil 23 has a first outlet terminal 231 and a second outlet terminal 232. The first outlet terminal 231 and the second outlet terminal 232 are outputted from two opposite sides of the middle post 211 of the first magnetic core 21. Similarly, the second winding coil 24 is a coil pancake that wound around the middle post 201 of the intermediate magnetic core 20 and the middle post 221 of the second magnetic core 22 and arranged around the second air gap 29. The second winding coil 24 has a first outlet terminal 241 and a second outlet terminal 242. The first outlet terminal 241 and the second outlet terminal 242 are outputted from two opposite sides of the middle post 201 (or the middle post 221). The second outlet terminal 232 of the first winding coil 23 and the second outlet terminal 242 of the second winding coil 24 are connected with each other by a welding means for example. The first outlet terminal 231 of the first winding coil 23 and the first outlet terminal 241 of the second winding coil 24 are outputted downwardly from the first winding space 26 and the second winding space 28 and penetrated through the corresponding perforations 250, respectively. Consequently, the first outlet terminal 231 of the first winding coil 23 and the first outlet terminal 241 of the second winding coil 24 are fixed by the base plate 25. The first outlet terminal 231 of the first winding coil 23 and the first outlet terminal 241 of the second winding coil 24 may be further electrically connected with an external circuit (not shown). In this embodiment, the first winding coil 23 and the second winding coil 24 are wound in the same winding direction. For example, the first winding coil 23 and the second winding coil 24 are wound in the clockwise winding direction.

In this embodiment, the connection part 200 of the intermediate magnetic core 20, the connection part 210 of the first magnetic core 21 and the connection part 220 of the second magnetic core 22 have the identical thickness. The lateral leg 202 of the intermediate magnetic core 20 has a first length H1, the lateral leg 212 of the first magnetic core 21 has a second length H2, and the lateral leg 222 of the second magnetic core 22 has a third length H3. In this embodiment, the second length H2 is larger than the first length H1 and the third length H3, and the first length H1 is equal to the third length H3. It is noted that the relationship between the first length H1, the second length H2 and the third length H3 is not restricted. For example, the relationship between the first length H1, the second length H2 and the third length H3 may be adjusted according to the turn numbers of the first winding coil 23 and the second winding coil 24 and the practical requirements. In this embodiment, the air-gap length of the first air gap 27 is equal to the air-gap length of the second air gap 29. It is noted that the air-gap length of the first air gap 27 and the air-gap length of the second air gap 29 may be adjusted according to the first length H1, the second length H2 and the third length H3 and the practical requirements. In case that the first length H1 is equal to the third length H3, the length of the middle post 201 of the intermediate magnetic core 20 is equal to the length of the middle post 221 of the second magnetic core 22. Consequently, the second air gap 29 is uniformly distributed between the intermediate magnetic core 20 and the second magnetic core 22.

In this embodiment, the intermediate magnetic core 20 and the first magnetic core 21 are coupled with each other through adhesive and/or tape (not shown), and the intermediate magnetic core 20 and the second magnetic core 22 are coupled with each other through adhesive and/or tape (not shown).

Figure 1A:
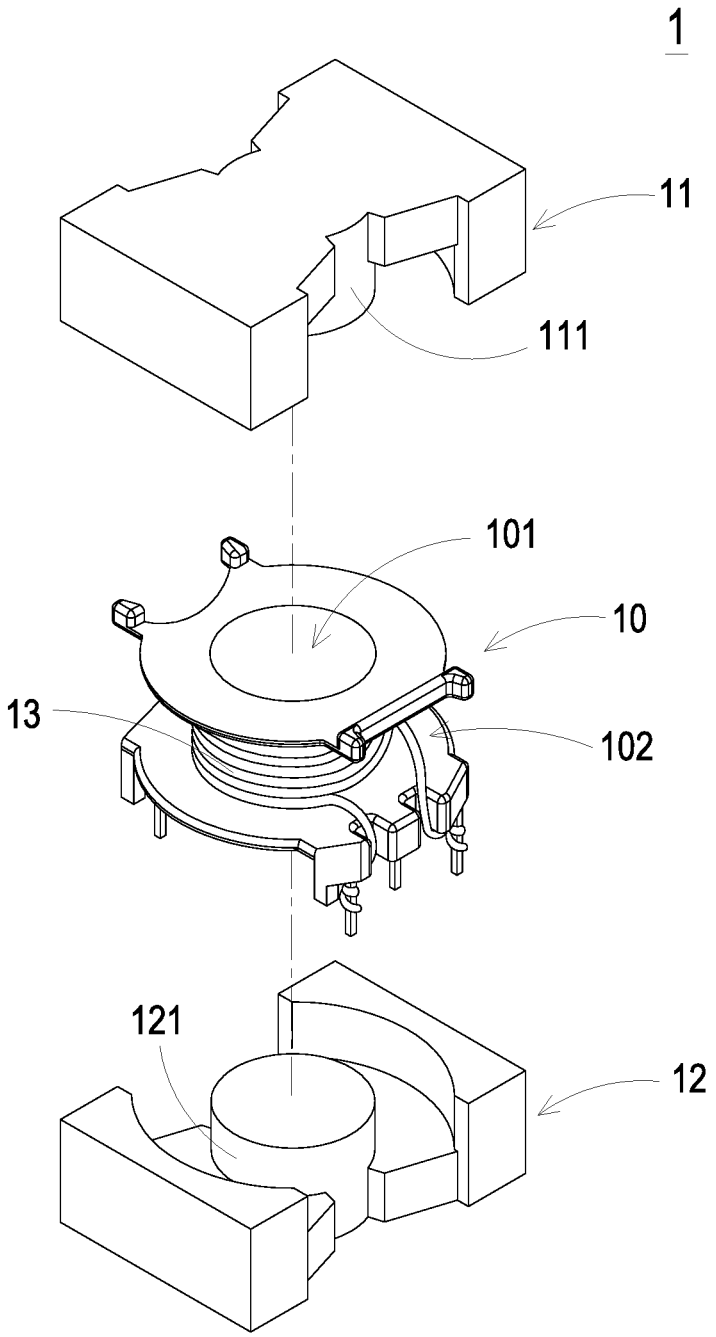
FIG.1A(PRIOR ART)
FIG. 1A is a schematic exploded view illustrating an inductor with an air gap.
Figure 1B:
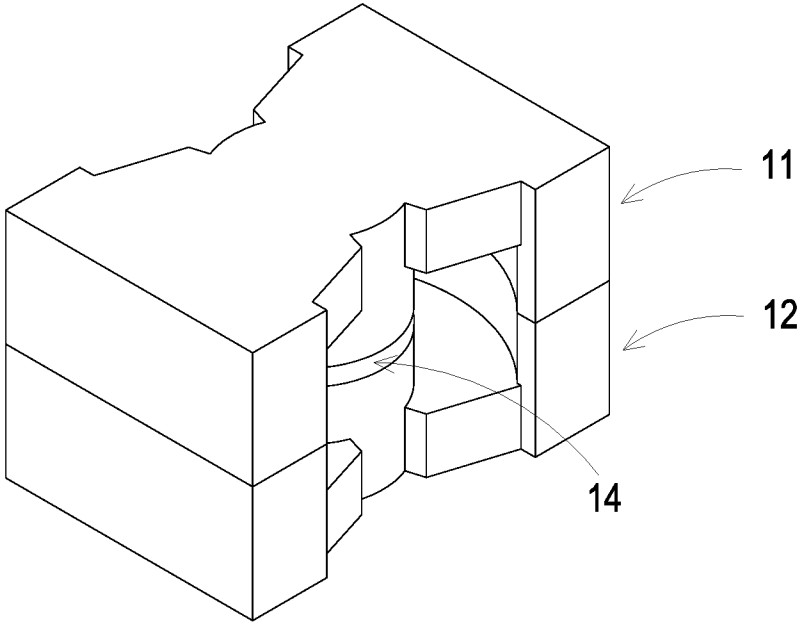
FIG.1B(PRIOR ART)
FIG. 1B is a schematic assembled view illustrating a portion of the inductor of FIG. 1A, in which the bobbin and the winding coil are not shown.

As shown in FIG. 1B, the conventional inductor 1 only has a single air gap and the air-gap length is larger than the present disclosure. In the magnetic element 2 of the present disclosure, the first winding coil 23 and the second winding coil 24 are connected with each other in series, and the magnetic element 2 has multiple air gaps. Under this circumstance, the air gaps are dispersed and the portions of the middle posts of the magnetic cores to be scraped off are reduced. That is, the overall air-gap length is reduced. For example, the air-gap length of the air gap 14 of the conventional inductor 1 is 6.10 mm and uniformly distributed among the first magnetic core 11 and the second magnetic core 12. That is, the air-gap length of the first magnetic core 11 and the air-gap length of the second magnetic core 12 are both 3.05 mm. That is, the portion of the middle post of the first magnetic core 11 to be scrapped off is 3.05 mm, and the portion of the second magnetic core 12 to be scrapped off is 3.05 mm. For achieving the same inductance value, the overall air-gap length of the magnetic element 2 of this embodiment is only 4 mm. For example, the air-gap length of the first air gap 27 and the air-gap length of the second air gap 29 are both 2 mm. The second air gap 29 is uniformly distributed among the intermediate magnetic core 20 and the second magnetic core 22. That is, the air-gap length of the intermediate magnetic core 20 is 1 mm, and the air-gap length of the second magnetic core 22 is also 1 mm. That is, when compared with the conventional inductor 1, the portions of the middle post 201 of the intermediate magnetic core 20, the middle post 211 of the first magnetic core 21 and the middle post 221 of the second magnetic core 22 to be scraped off are reduced. Since the overall air-gap length is reduced, the eddy loss is decreased, and the overall temperature of the magnetic element 2 is reduced. In other words, the magnetic cores stacked in the asymmetric configuration can reduce the overall air-gap length and enhance the working efficiency.

Figure 4:
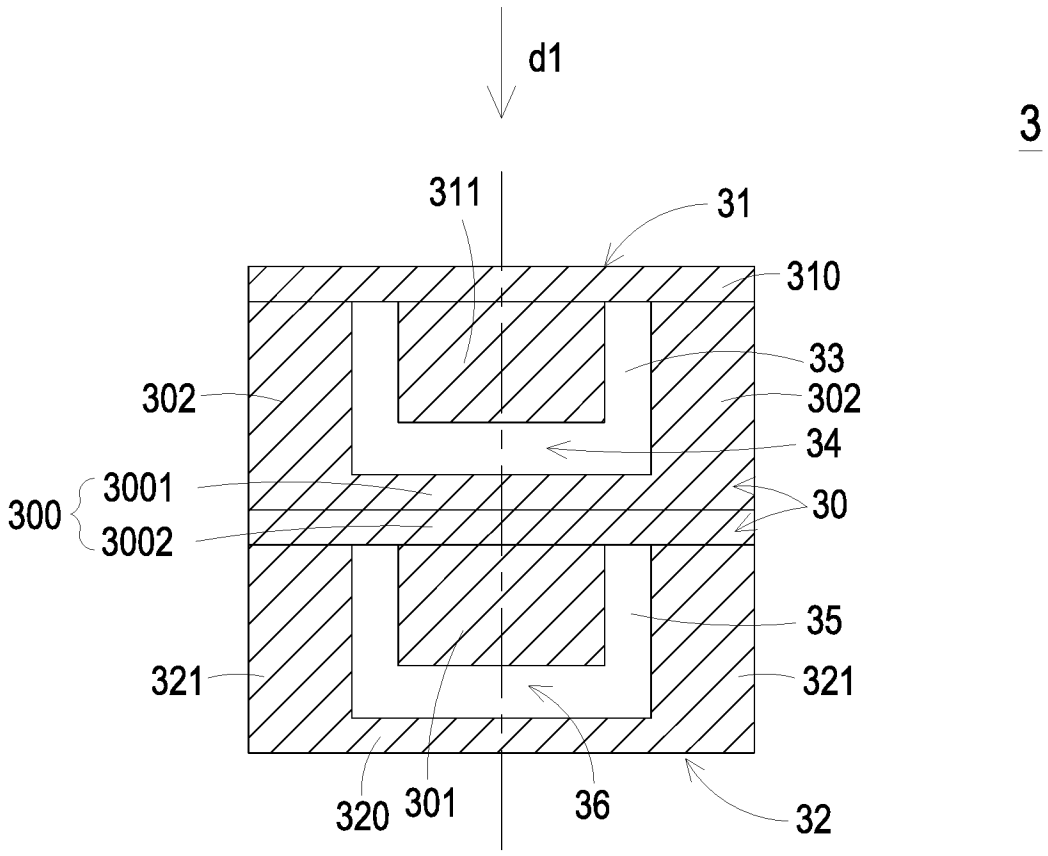
FIG. 4 is a schematic cross-sectional view illustrating the magnet cores of a magnetic element according to a second embodiment of the present disclosure.

FIG. 4 is a schematic cross-sectional view illustrating the magnet cores of a magnetic element according to a second embodiment of the present disclosure. As shown in FIG. 4, the magnetic element 3 comprises an intermediate magnetic core 30, a first magnetic core 31, a second magnetic core 32, a first winding coil (not shown), a second winding coil (not shown), a first winding space 33, a first air gap 34, a second winding space 35, and a second air gap 36. Except for the following items, the configurations of the magnetic element 3 are substantially identical to those of the magnetic element 2 of the first embodiment. In comparison with the magnetic element 2 of the first embodiment, the types of the magnetic cores of the magnetic element 3 of this embodiment are distinguished. The intermediate magnetic core 30 is a Y-shaped core or a combination of a U-shaped core and a T-shaped core. The first magnetic core 31 is a T-shaped core, and the second magnetic core 32 is a U-shaped core. A first magnetic path is defined by the intermediate magnetic core 30, the first magnetic core 31 and the first air gap 34 collaboratively. A second magnetic path is defined by the intermediate magnetic core 30, the second magnetic core 32 and the second air gap 36 collaboratively. After the stacked magnetic core assembly with the three magnetic cores, the first winding coil and the second winding coil are combined together, the magnetic element 3 is fabricated. The magnetic element 3 has at least two magnetic paths with leakage flux. In this embodiment, the U-shaped core and the T-shaped core of the intermediate magnetic core 30 are connected with each other via an adhesive. In this embodiment, the intermediate magnetic core 30 and the first magnetic core 31 are coupled with each other through adhesive and/or tape (not shown). The intermediate magnetic core 30 and the second magnetic core 32 are coupled with each other through adhesive and/or tape (not shown).

Please refer to FIG. 4 again. The intermediate magnetic core 30 comprises a connection part 300, a middle post 301, and two lateral legs 302. The first magnetic core 31 comprises a connection part 310, and a middle post 311. The second magnetic core 32 comprises a connection part 320, and two lateral legs 321. The connection part 300 of the intermediate magnetic core 30 comprises an upper connection section 3001 and a lower connection section 3002. The bottom surface of the upper connection section 3001 is coupled with the top surface of the lower connection section 3002. The two lateral legs 302 of the intermediate magnetic core 30 are protruded from two edges of the upper connection section 3001. The middle post 301 of the intermediate magnetic core 30 is protruded from the lower connection section 3002. In this embodiment, the upper connection section 3001 and the lower connection section 3002 of the intermediate magnetic core 30, the connection part 310 of the first magnetic core 31 and the connection part 320 of the second magnetic core 32 have the same thickness.

In this embodiment, both of the intermediate magnetic core 30 and the first magnetic core 31 comprise a T-shaped core. Consequently, the first winding coil and the second winding coil may be wound around the middle post 311 of the first magnetic core 31 and the middle post 301 of the intermediate magnetic core 30 by an automatic winding machine. Since the first winding coil and the second winding coil can be automatically wound, the cost of winding the coils will be reduced.

From the above descriptions, the present disclosure provides a magnetic element with multiple air gaps. The coils are directly wound around the magnetic cores without the need of using bobbin. Consequently, the fabricating cost is reduced, and the coil utilization is enhanced. Since the multiple air gaps of the magnetic element are dispersedly distributed, the eddy loss is reduced and the dispersing flux is decreased. Under this circumstance, the working temperature of the magnetic element is decreased, and the working efficiency of the magnetic element is enhanced. Moreover, since the magnetic cores are stacked in an asymmetric configuration and the winding coils are connected with each other in series, the magnetic force lines between the two winding coils are partially balanced. Under this circumstance, the thickness of the intermediate magnetic core is reduced, the overall volume is reduced, and the magnetic element is slim.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic element with multiple air gaps, the magnetic element comprising:

a first magnetic core;

a second magnetic core;

an intermediate magnetic core arranged between the first magnetic core and the second magnetic core, wherein after the first magnetic core and the intermediate magnetic core are coupled with each other, a first winding space and a first air gap are defined, wherein after the second magnetic core and the intermediate magnetic core are coupled with each other, a second winding space and a second air gap are defined;

a first winding coil disposed within the first winding space;

a second winding coil disposed within the second winding space; and a base plate, wherein the base plate comprises a plurality of perforations, and the base plate is attached on a bottom surface of the second magnetic core, wherein the first magnetic core, the intermediate magnetic core, the second magnetic core, and the base plate are stacked along a first direction, the first winding coil and the second winding coil are connected with each other in series, and an outlet terminal of the first winding coil and an outlet terminal of the second winding coil are penetrated through the perforations along the first direction and fixed by the base plate.

2. The magnetic element according to claim 1, wherein the intermediate magnetic core, the first magnetic core and the second magnetic core are E-shaped cores, and the intermediate magnetic core, the first magnetic core and the second magnetic core are stacked in an asymmetric configuration.

3. The magnetic element according to claim 1, wherein each of the intermediate magnetic core, the first magnetic core and the second magnetic core comprises a connection part, a middle post and two lateral legs.

4. The magnetic element according to claim 3, wherein the first air gap is formed between the middle post of the first magnetic core and a top surface of the connection part of the intermediate magnetic core, and the second air gap is formed between the middle post of the intermediate magnetic core and the middle post of the second magnetic core.

5. The magnetic element according to claim 3, wherein an air-gap length of the first air gap is equal to an air-gap length of the second air gap.

6. The magnetic element according to claim 3, wherein the connection part of the intermediate magnetic core, the connection part of the first magnetic core and the connection part of the second magnetic core have identical shape and thickness.

7. The magnetic element according to claim 3, wherein a length of the lateral leg of the intermediate magnetic core is equal to a length of the lateral leg of the second magnetic core, and a length of the lateral leg of the first magnetic core is larger than the length of the lateral leg of the intermediate magnetic core.

8. The magnetic element according to claim 7, wherein a length of the middle post of the intermediate magnetic core is equal to a length of the middle post of the second magnetic core.

9. The magnetic element according to claim 1, wherein the intermediate magnetic core is a Y-shaped core or a combination of a first U-shaped core and a first T-shaped core, the first magnetic core is a second T-shaped core, and the second magnetic core is a second U-shaped core.

* * * * *